US012484755B2

(12) United States Patent
Hwang et al.

(10) Patent No.: US 12,484,755 B2
(45) Date of Patent: Dec. 2, 2025

(54) DISHWASHER

(71) Applicant: LG ELECTRONICS INC., Seoul (KR)

(72) Inventors: Jukwang Hwang, Seoul (KR); Jae Chul Lee, Seoul (KR); Jin Tae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 240 days.

(21) Appl. No.: 18/037,036

(22) PCT Filed: Nov. 24, 2020

(86) PCT No.: PCT/KR2020/016672
§ 371 (c)(1),
(2) Date: May 15, 2023

(87) PCT Pub. No.: WO2022/102840
PCT Pub. Date: May 19, 2022

(65) Prior Publication Data

US 2023/0404357 A1 Dec. 21, 2023

(30) Foreign Application Priority Data

Nov. 16, 2020 (KR) ..... 10-2020-0152819

(51) Int. Cl.
*A47L 15/22* (2006.01)
*A47L 15/23* (2006.01)
*A47L 15/42* (2006.01)

(52) U.S. Cl.
CPC ..... *A47L 15/23* (2013.01); *A47L 15/4282* (2013.01); *A47L 2401/24* (2013.01); *A47L 2501/20* (2013.01)

(58) Field of Classification Search
CPC ..... A47L 15/0049; A47L 15/22; A47L 15/23; A47L 15/28; A47L 15/34; A47L 15/428;
(Continued)

(56) References Cited

U.S. PATENT DOCUMENTS 6,675,818 B1 * 1/2004 Schrott ..... A47L 15/0049 134/57 D
2007/0057665 A1 * 3/2007 Borst ..... G01D 11/245 324/207.2

(Continued)

FOREIGN PATENT DOCUMENTS

DE 3732451 A1 4/1989
DE 102005033110 1/2007

(Continued)

OTHER PUBLICATIONS

Machine Translation of Klose, DE 3732451-A1, Apr. 1989. (Year: 1989).*

(Continued)

*Primary Examiner* — David G Cormier
(74) *Attorney, Agent, or Firm* — Fish & Richardson P.C.

(57) ABSTRACT

The present disclosure relates to a dishwasher. The dishwasher of one embodiment comprises a tub having a wash space in which a wash target is accommodated, a sump being disposed at a lower end of the tub and storing wash water, a wash pump supplying wash water that is accommodated in the sump to a nozzle, a rack being disposed in the wash space and storing a wash target, a nozzle being disposed at a lower end of the rack, being rotated by a repulsive force of wash water that is supplied from the wash pump, spraying wash water to a wash target, and having one end to which a magnetic object is coupled, a sensing module being disposed in an area that corresponds to a range in which the nozzle operates and comprising a Hall sensor that senses a magnetic force generated by the magnetic object, and a controller receiving sensing results from the sensing module and determining one or more of whether the nozzle rotates, a rotation speed of the nozzle and a rotation direction of the nozzle, based on the sensing results, to output an abnormal-
(Continued)

ity notification to a user or control wash water that is supplied to the nozzle through the wash pump.

17 Claims, 18 Drawing Sheets

(58) Field of Classification Search
CPC ..... A47L 15/504; A47L 2401/24; A47L 2501/20; A47L 2501/26
See application file for complete search history.

(56) References Cited

U.S. PATENT DOCUMENTS

| | | | | |
|---|---|---|---|---|
| 2013/0139860 | A1* | 6/2013 | Forster | A47L 15/23 134/198 |
| 2014/0053873 | A1* | 2/2014 | Watson | A47L 15/0031 134/18 |
| 2018/0008119 | A1* | 1/2018 | Pleschinger | A47L 15/4409 |
| 2019/0290095 | A1 | 9/2019 | Wahlberg et al. | |
| 2020/0237179 | A1* | 7/2020 | Haegermarck | A47L 15/4409 |

FOREIGN PATENT DOCUMENTS

| | | |
|---|---|---|
| DE | 102006007329 | 8/2007 |
| DE | 102012100671 | 8/2013 |
| JP | 200822813 | 10/2008 |
| JP | 2009089967 | 4/2009 |
| KR | 10-2007-0015710 A | 2/2007 |
| KR | 20080049101 | 6/2008 |

OTHER PUBLICATIONS

Extended European Search Report in European Appln. No. 20961710.9, mailed on Sep. 3, 2024, 11 pages.

* cited by examiner

DISHWASHER

CROSS-REFERENCE TO RELATED APPLICATIONS

This application is a National Stage application under 35 U.S.C. § 371 of International Application No. PCT/KR2020/016672, filed on Nov. 24, 2020, which claims the benefit of Korean Patent Application No. 10-2020-0152819, filed on Nov. 16, 2020. The disclosures of the prior applications are incorporated by reference in their entirety.

TECHNICAL FIELD

The present disclosure relates to a dishwasher.

BACKGROUND ART

Dishwashers are home appliances that spray wash water to wash targets such as cooking vessels or cooking tools and the like, to remove foreign substances remaining at the wash targets.

A dishwasher ordinarily comprises a tub providing a wash space, a rack being provided in the tub and accommodating cooking vessels, a nozzle spraying wash water to the rack, a sump storing wash water, and a wash pump supplying the washer water stored in the sump to the nozzle.

The nozzle sprays wash water to wash targets evenly, while rotating. However, in the case where wash targets are disposed in an area where the nozzle rotates, the wash targets can prevent the nozzle from rotating smoothly. Additionally, in the case where contaminants are excessively stacked at a filter around the wash pump, the nozzle cannot rotate smoothly, for the reason that wash water supplied from the wash pump cannot be supplied to the nozzle smoothly, and the like. At this time, the wash targets are not washed properly by the wash water, causing deterioration in the wash performance of the dishwasher.

To solve the above problem caused by failure to rotate a nozzle smoothly, an example dishwasher capable of sensing whether a nozzle rotates is disclosed in DE 10-2006-007329 that was patented.

The dishwasher senses the alternation of a magnetic field generated by a magnetic object that is included at both ends of a nozzle, by using a Hall sensor, to sense whether the nozzle rotates. However, since the sensing area of the Hall sensor is limited, when the position of the nozzle changes, the change in the magnetic field caused by the magnetic material becomes weak, so the Hall sensor cannot detect whether the nozzle rotates.

In addition, since the Hall sensor detects the rotation of the nozzle as it detects the alternating polarity of the magnet, the Hall sensor cannot detect the rotation of the nozzle unless two magnets are inserted with opposite polarities at both ends of the nozzle.

Furthermore, if the rotation direction and rotation speed of the nozzle are not detected by the Hall sensor, there is a problem in that the rotation of the nozzle cannot be accurately controlled.

Therefore, there is a need to develop a dishwasher to improve the problems as described above.

DESCRIPTION OF INVENTION

Technical Problems

The objective of the present disclosure is to provide a dishwasher capable of sensing whether a nozzle rotates even if the position of the nozzle changes.

The objective of the present disclosure is to provide a dishwasher capable of sensing whether a nozzle rotates, with a single magnet that is inserted regardless of polarity.

The objective of the present disclosure is to provide a dishwasher capable of sensing a rotation direction and a rotation speed of a nozzle, to control the rotation of the nozzle precisely.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solutions

A dishwasher according to the present disclosure comprises a nozzle having one end to which a magnetic object is coupled, a sensing module being disposed in an area that corresponds to a range in which the nozzle operates and comprising a Hall sensor that senses a magnetic force generated by the magnetic object, and a controller determining one or more of whether the nozzle rotates, a rotation speed of the nozzle and a rotation direction of the nozzle, based on sensing results received from the sensing module.

With the configuration, it can be sensed whether the nozzle rotates even if the position of the nozzle changes.

A dishwasher of one embodiment comprises a tub having a wash space in which a wash target is accommodated, a sump being disposed at a lower end of the tub and storing wash water, a wash pump supplying the wash water that is accommodated in the sump to a nozzle, a rack being disposed in the wash space and storing the wash target, a nozzle being disposed at a lower end of the rack, being rotated by a repulsive force of the wash water that is supplied from the wash pump, spraying the wash water to the wash target, and having one end to which a magnetic object is coupled, a sensing module being disposed in an area that corresponds to a range in which the nozzle operates, and comprising a Hall sensor that senses a magnetic force generated by the magnetic object, and a controller receiving sensing results from the sensing module, and determining one or more of whether the nozzle rotates, a rotation speed of the nozzle and a rotation direction of the nozzle, based on the sensing results, to output an abnormality notification to a user or control wash water that is supplied to the nozzle through the wash pump.

In one embodiment, the rack comprises a first rack being disposed in an upper portion of the wash space and moving up and down to N (natural umbers of 2 or greater) number of positions, the nozzle comprises a first nozzle being disposed at a lower end of the first rack and moving up and down to N number of the positions together with the first rack, and the sensing module comprises a first sensing module comprising N−1 number of Hall sensors that are disposed in positions corresponding to N number of the positions.

In one embodiment, a first magnetic object is coupled to one end of the first nozzle, and a first weight having weight that corresponds to weight of the first magnetic object is accommodated at the other end of the first nozzle.

In one embodiment, the dishwasher further comprises a door being provided on one surface of the tub and opening and closing the wash space, a dispenser being disposed in one area of the door and supplying detergents to the wash space, and a fixation bracket which is coupled to the dispenser and on which the first sensing module is mounted.

In one embodiment, the controller determines positions of the first rack and the first nozzle, among N number of the positions, based on which Hall sensor senses a magnetic force generated by the magnetic object, among N−1 number of the Hall sensors.

In one embodiment, the first sensing module comprises a first Hall sensor part comprising N−1 number of Hal sensors that are disposed in positions corresponding to N number of the positions, and a second Hall sensor part being disposed at one side of the first Hall sensor part and comprising N−1 number of Hall sensors that are disposed in positions corresponding to N number of the positions.

In one embodiment, the controller determines a rotation direction of the first nozzle, based on an order in which the first Hall sensor part and the second Hall sensor part sense a magnetic force generated by the magnetic object.

In one embodiment, the rack comprises a second rack being disposed in a lower portion of the wash space, the nozzle comprises a second nozzle being disposed at a lower end of the second rack, and the sensing module comprises a second sensing module being coupled to one side of the sump.

In one embodiment, a second magnetic object is coupled to one end of the second nozzle, and a second weight having weight that corresponds to weight of the second magnetic object is accommodated at the other end of the second nozzle.

In one embodiment, the controller calculates a rotation speed of the nozzle by using magnetic force sensing time and magnetic force non-sensing time through the sensing module.

In one embodiment, the controller outputs an abnormality notification to a user when the magnetic force non-sensing time through the sensing module is predetermined reference time or greater.

In one embodiment, the controller outputs an abnormality notification to a user, when a rotation speed of the nozzle is less than a predetermined minimum rotation speed.

In one embodiment, the controller controls wash water that is supplied to the nozzle through the wash pump, based on results of comparison between a rotation speed of the nozzle and a predetermined reference rotation speed.

In one embodiment, the reference rotation speed is set differently depending on a rotation direction of the nozzle.

In one embodiment, the controller controls wash water that is supplied to the nozzle through the wash pump, when the rotation speed of the nozzle is less than the reference rotation speed, to increase the rotation speed of the nozzle, and controls wash water that is supplied to the nozzle through the wash pump, when the rotation speed of the nozzle is the reference rotation speed or greater, to decrease the rotation speed of the nozzle.

Advantageous Effects

In a dishwasher of the present disclosure, N−1 number of Hall sensors disposed in positions corresponding to N number of positions to which a nozzle moves are used to sense whether the nozzle rotates, even if the positions of the nozzle changes.

In the dishwasher of the present disclosure, a magnetic object is disposed at one end of the nozzle, and a weight is disposed at the other end of the nozzle, to enable the nozzle to rotate smoothly.

In the dishwasher of the present disclosure, a first Hall sensor part, and a second Hall sensor part disposed at one side of the first Hall sensor part sense a rotation direction and a rotation speed of the nozzle, to control the rotation of the nozzle precisely, ensuring improvement in the performance of the dishwasher.

Specific effects are described along with the above-described effects in the section of detailed description.

DETAILED DESCRIPTION OF EXEMPLARY EMBODIMENTS

Figure 1:
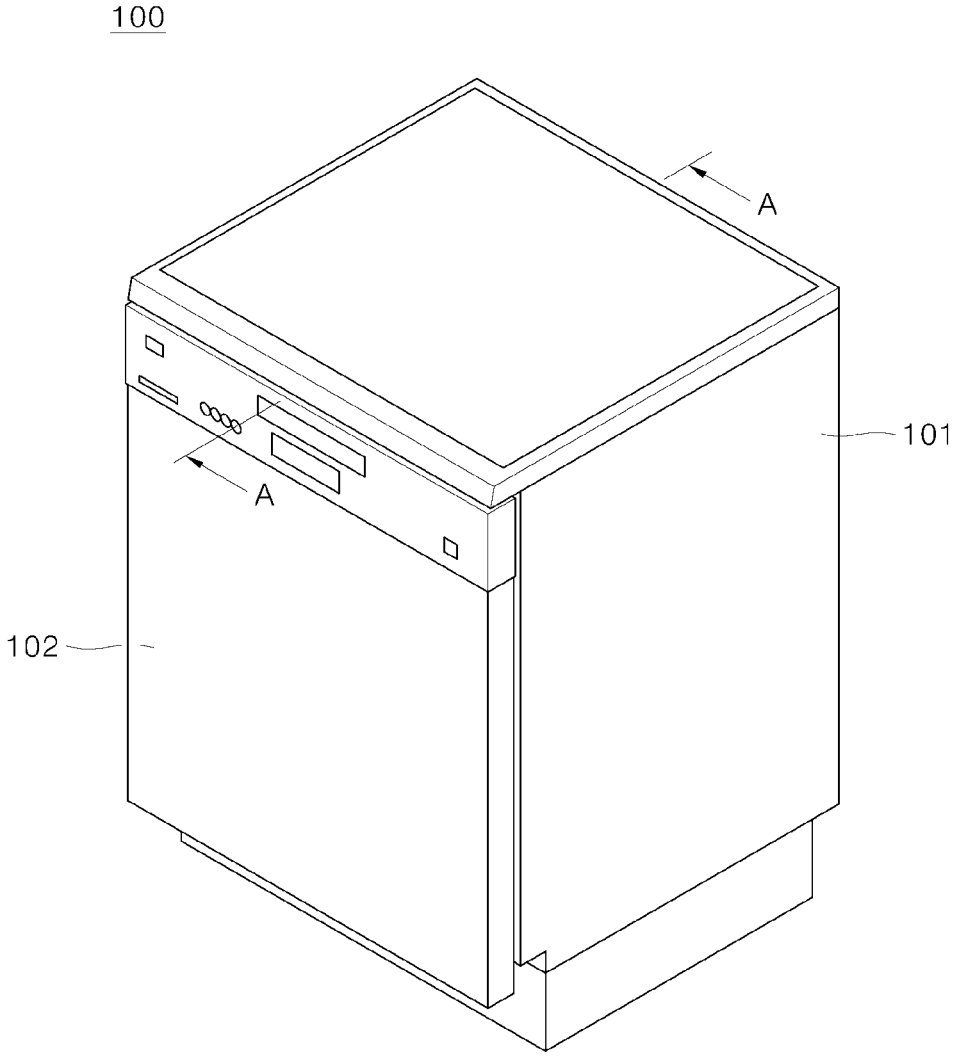
FIG. 1 is a perspective view showing a dishwasher of one embodiment.

The above-described aspects, features and advantages are specifically described hereafter with reference to accompanying drawings such that one having ordinary skill in the art to which the present disclosure pertains can embody the technical spirit of the disclosure easily. In the disclosure, detailed description of known technologies in relation to the subject matter of the disclosure is omitted if it is deemed to make the gist of the disclosure unnecessarily vague. Hereafter, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components are not to be limited by the terms. Certainly, a first component can be a second component, unless stated to the contrary.

When one component is described as being "in the upper portion (or lower portion)" or "on (or under)" another component, one component can be directly on (or under) another component, and an additional component can be interposed between the two components.

When any one component is described as being "connected", "coupled", or "connected" to another component, any one component can be directly connected or coupled to another component, but an additional component can be "interposed" between the two components or the two components can be "connected", "coupled", or "connected" by an additional component.

Throughout the disclosure, each component can be provided as a single one or a plurality of ones, unless explicitly stated to the contrary.

The singular forms "a", "an" and "the" are intended to include the plural forms as well, unless explicitly indicated otherwise. It is to be further understood that the terms "comprise" or "include" and the like, set forth herein, are not interpreted as necessarily including all the stated components or steps but can be interpreted as excluding some of the stated components or steps or can be interpreted as including additional components or steps.

Hereafter, a dishwasher of several embodiments is described.

FIG. 1 is a perspective view showing a dishwasher of one embodiment.

Referring to FIG. 1, the exterior of the dishwasher 100 of one embodiment is illustrated in a perspective view. The dishwasher 100 of one embodiment may comprise a case 101 and a door 102.

The case 101 forms the exterior of the dishwasher 100. The case 101 may be shaped into a cuboid one surface of which is open, and have a tub 110 therein.

The door 102 is provided on one surface of the case 101, which is open, and opens and closes a vacant space in the case 101. The door 102 may be opened or closed automatically or manually.

Components disposed in the vacant space of the case 101 are described with reference to FIGS. 2 and 3.

Figure 2:
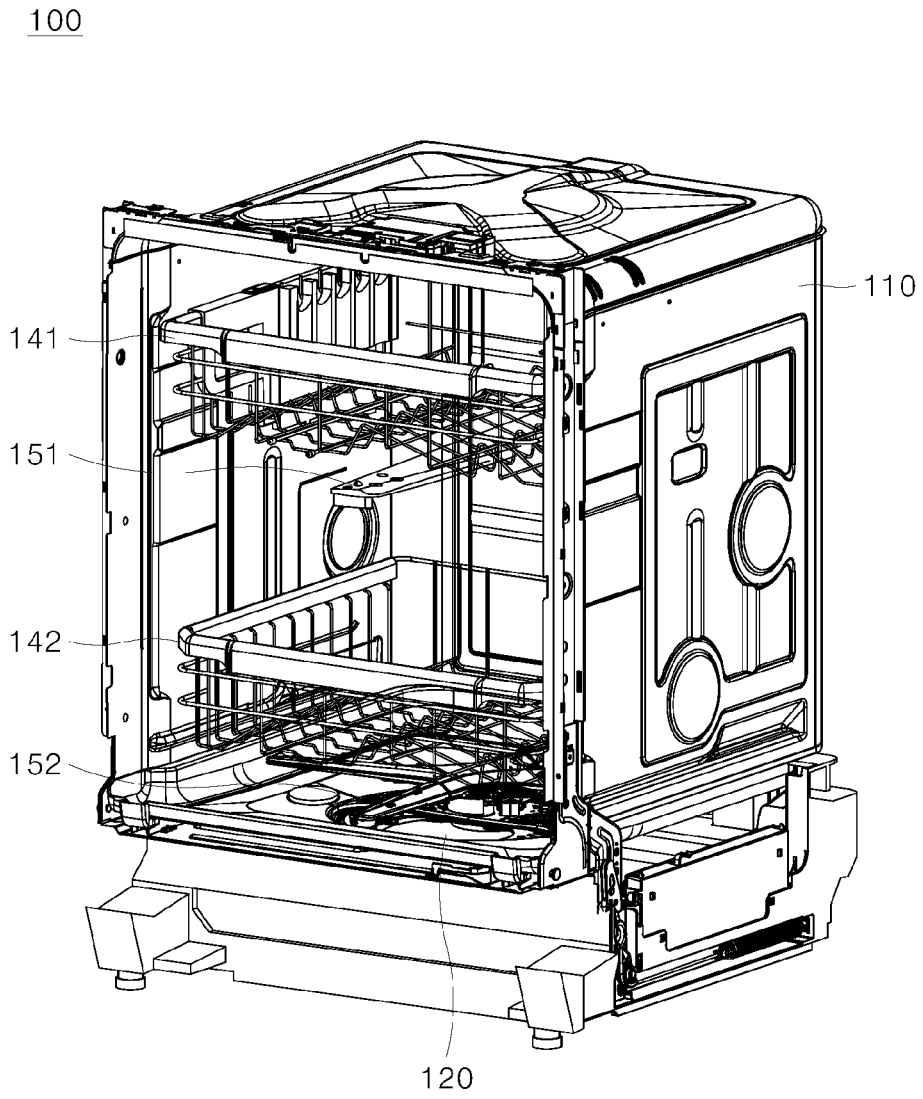
FIG. 2 is a perspective view showing the dishwasher of one embodiment without a case and a door.

FIG. 2 is a perspective view showing the dishwasher of one embodiment without a case and a door. FIG. 3 is a cross-sectional view along line "A-A" of FIG. 1

Figure 3:
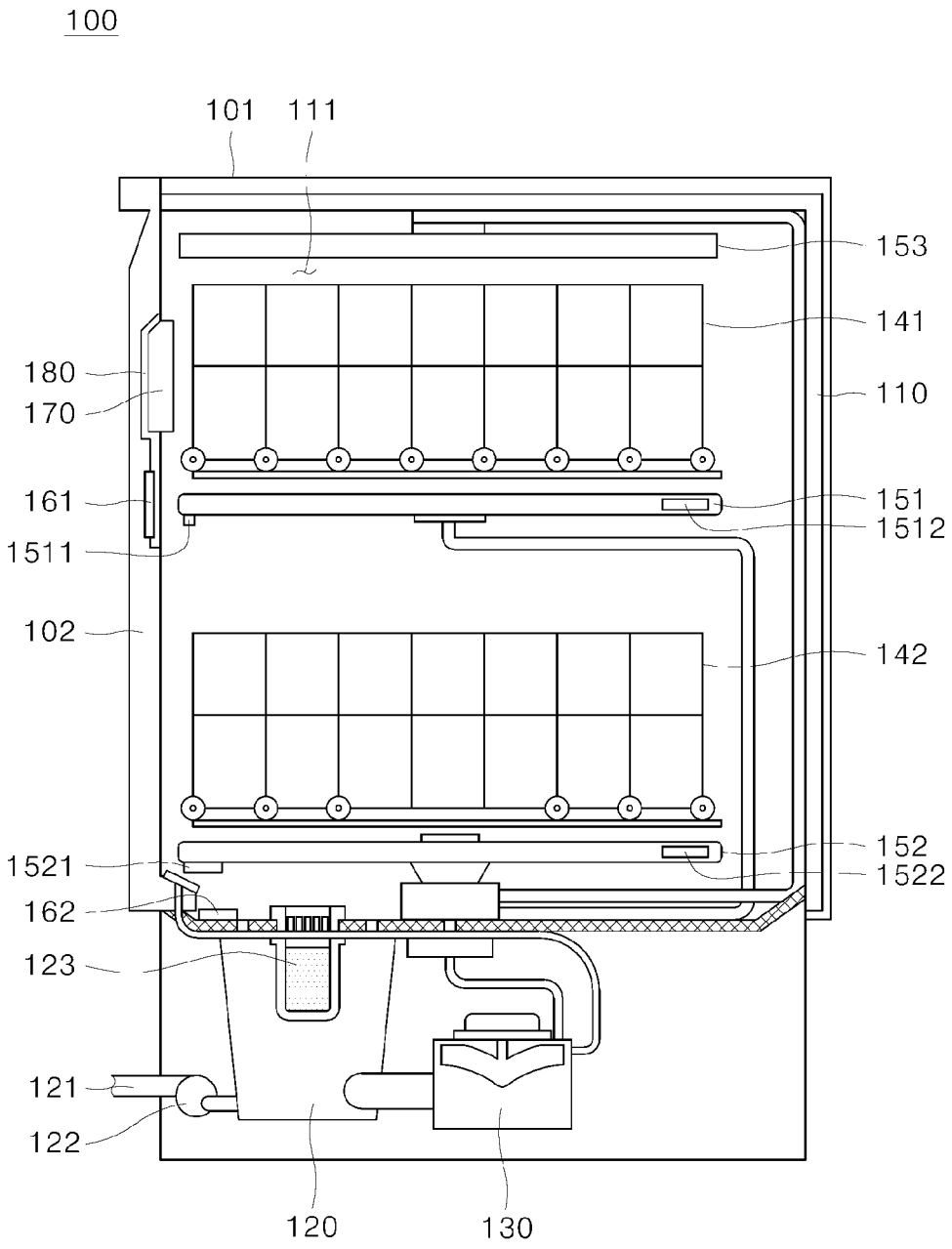
FIG. 3 is a cross-sectional view along line "A-A" of FIG. 1.

Referring to FIGS. 2 and 3, the dishwasher 100 of one embodiment comprises a tub 110, a sump 120, a wash pump 130, racks 141, 142, nozzles 151, 152, 153 and sensing modules 161, 162. Though not illustrated in the drawing, the dishwasher 100 of one embodiment comprises a controller. Additionally, the dishwasher 100 of one embodiment may further comprise a dispenser 170 and a fixation bracket 180.

The tub 110 may be provided in the case 101, and shaped into a cuboid one surface of which is open. At this time, one surface of the tub 110, which is open, may be a surface corresponding to one surface of the case 101, which is open. Accordingly, one surface of the tub 110, which is open, may be opened and closed by the door 102. A wash space 111 in which wash targets are accommodated is formed in the tub 110.

The sump 120 is disposed at the lower end of the tub 110. The sump 120 stores wash water, and collects wash water that is used to wash wash targets.

The sump 120 connects to a drainage path 121 that guides stored wash water to the outside of the dishwasher 100. The sump 120 may discharge wash water out of the dishwasher 100 through the drainage path 121.

A drainage pump 122 may discharge wash water stored in the sump 120 through the drainage path 121. The drainage pump 122 may comprise a drainage motor (not illustrated) that generates a rotational force. As the drainage pump 122 operates, wash water stored in the sump 120 may be discharged out of the dishwasher 100 through the drainage path 121.

A filter 123 is disposed between the tub 110 and the sump 120, to filter contaminants included in wash water that flows into the sump 120 from the tub 110.

The wash pump 130 may supply wash water stored in the sump 120 to the nozzles 151, 152, 153. The wash pump 130 may comprise a wash motor (not illustrated) that generates a rotational force. As the wash pump 130 operates, wash water stored in the sump 120 may be supplied to the nozzles 151, 152, 153. The wash pump 130 may operate based on an instruction that is received from the controller described hereafter.

The racks 141, 142 are disposed in the wash space 111, and accommodates wash targets. The racks 141, 142 may comprise a first rack 141 and a second rack 142. The first rack 141 may be disposed in the upper portion of the wash space 111, and the second rack 142 may be disposed in the lower portion of the wash space 111.

The nozzles 151, 152, 153 are disposed in the wash space 111, and spray wash water to wash targets. The nozzles 151, 152, 153 may comprise a first nozzle 151, a second nozzle 152 and a third nozzle 153.

The first nozzle 151 may be disposed at the lower end of the first rack 141, and spray wash water upward. That is, the first nozzle 151 may spray wash water to wash targets accommodated in the first rack 141. In one embodiment, the first nozzle 151 may spray wash water to wash targets while rotating based on a repulsive force of wash water that is supplied from the sump 120.

The second nozzle 152 may be disposed at the lower end of the second rack 142, and spray wash water upward. That is, the second nozzle 152 may spray wash water to wash targets stored in the second rack 142. In one embodiment, the second nozzle 152 may spray wash water to wash targets while rotation based on a repulsive force of wash water that is supplied from the sump 120.

The third nozzle 153 may be disposed at the upper end of the first rack 141, and spray wash water downward. That is, the third nozzle 153 may spray wash water to wash targets stored in the first rack 141 and the second rack 142. In one embodiment, the third nozzle 153 may spray wash water to wash targets while the third nozzle 142 does not rotate.

As describe above, in the dishwasher 100 of one embodiment, the first nozzle 151 and the second nozzle 152 spray wash water while they rotate, and the third nozzle 153 may spray wash water while it does not rotate, but are not limited. Hereafter, description is provided on the dishwasher 100's first nozzle 151 and second nozzle 152 that spray wash water while they rotate, and the dishwasher 100's third nozzle 153 that sprays wash water while it does not rotate, for convenience of description.

The sensing modules 161, 162 is disposed in an area corresponding to a range in which the nozzles 151, 152, 153 operate and comprises a Hall sensor sensing a magnetic force generated by a magnetic object. The sensing modules 161, 162 may comprise a first sensing module 161 and a second sensing module 162.

Detailed structures of the racks 141, 142, the nozzles 151, 152, 153 and the sensing modules 161, 162 are described with reference to FIGS. 4 to 15.

Figure 4:
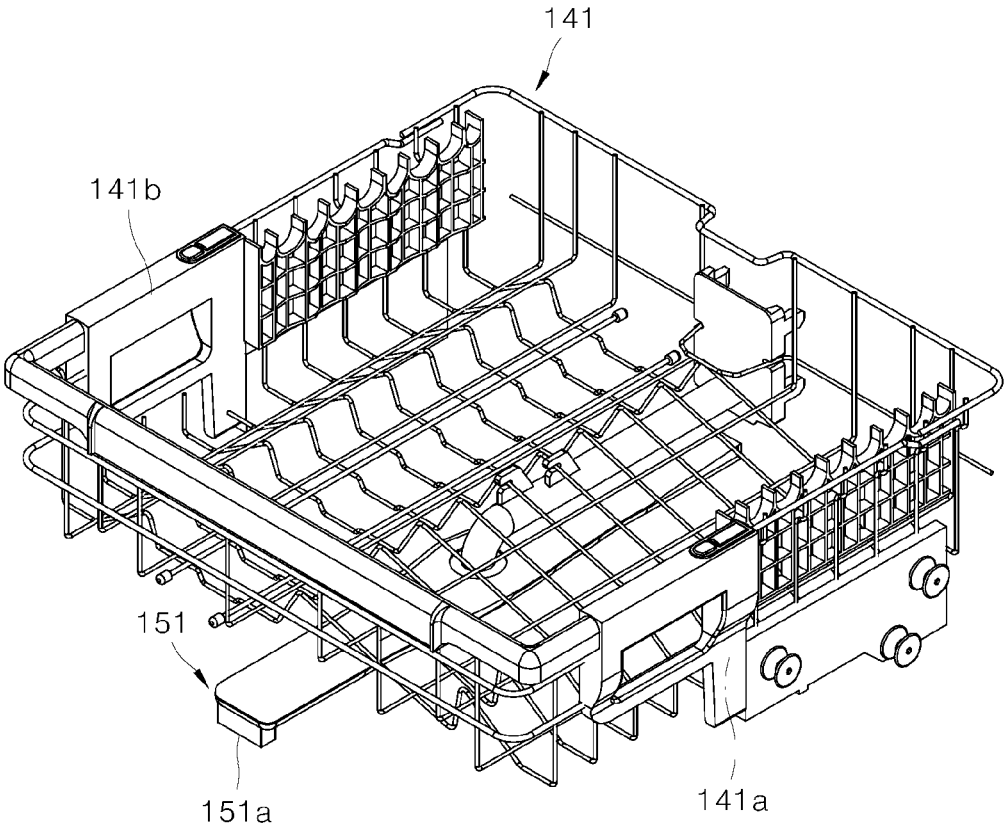
FIG. 4 is a perspective view showing a first rack and a first nozzle of the dishwasher of one embodiment only.

FIG. 4 is a perspective view showing a first rack and a first nozzle of the dishwasher of one embodiment only.

Referring to FIG. 4, the first rack 141 may connect to the first nozzle 151.

The first rack 141 may comprise height adjustment parts 141*a*, 141*b*. The height adjustment parts 141*a*, 141*b* allows the first rack 141 to move up and down within a predetermined operation range. At this time, the height adjustment parts 141*a*, 141*b* may allow the first rack 141 to be disposed in any one of N (N is natural numbers greater than 2) number of positions. That is, as the user moves the first rack 141 upward or downward, the height adjustment parts 141*a*, 141*b* allows the first rack 141 to be disposed in any one of N number of positions within the operation range. The first rack 141, as described above, may be moved up and down to N number of positions by the height adjustment parts 141*a*, 141*b*.

At this time, the first nozzle 151 may connect to the first rack 141. Accordingly, the first nozzle 151 may move up and down to N number of positions, together with the first rack 141.

A first magnetic object 1511 is coupled to one end of the first nozzle 151, and a first weight 1512 may be provided at the other end of the first nozzle 151. A detailed structure of the first nozzle 151 is described with reference to FIG. 5.

Figure 5:
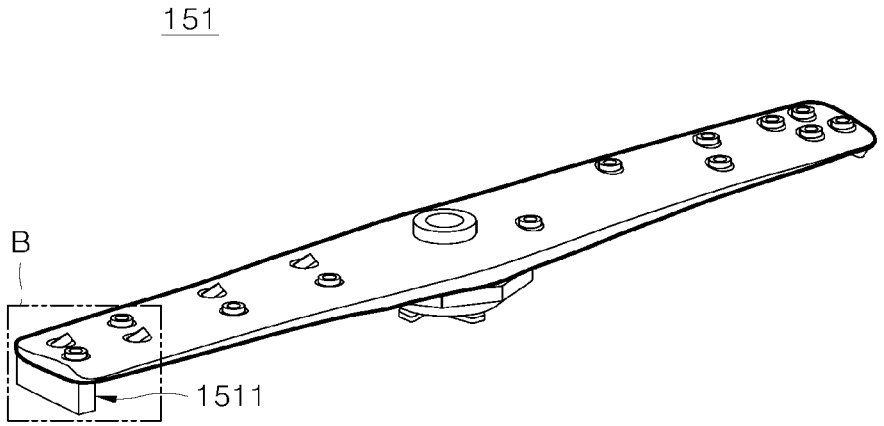
FIG. 5 is a perspective view showing the first nozzle of the dishwasher of one embodiment only.

FIG. 5 is a perspective view showing the first nozzle of the dishwasher of one embodiment only.

Referring to FIG. 5, a first magnetic object 1511 is coupled to one end of the first nozzle 151. Though not illustrated in FIG. 5, a first weight 1512 is accommodated at the other end of the first nozzle 151 as illustrated in FIG. 3. Since the first magnetic object 1511 causes a change in a magnetic field by rotating together with the first nozzle 151, as the first nozzle 151 rotates, to enable the first sensing module 161 to sense a magnetic force generated by the first magnetic object 1511. In one embodiment, the first magnetic object 1511 may be a magnet.

Figure 6:
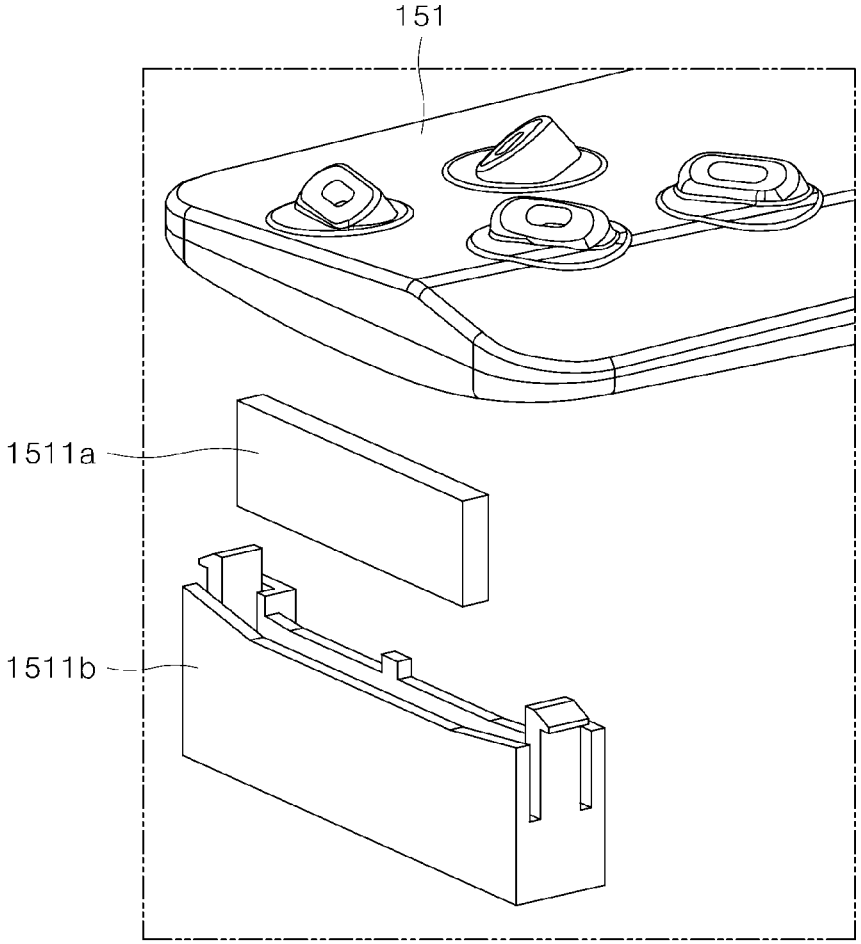
FIG. 6 is a view separately showing a structure in which a first magnetic object is coupled to the first nozzle, in the dishwasher of one embodiment.

A structure in which the first magnetic object 1511 is coupled to the first nozzle 151 is shown in FIG. 6.

FIG. 6 is a view separately showing a structure in which a first magnetic object is coupled to the first nozzle, in the dishwasher of one embodiment.

Referring to FIG. 6, the first magnetic object 1511 may be coupled to the lower side of one end of the first nozzle 151.

The first magnetic object 1511 may be coupled to the lower side of one end of the first nozzle 151 in a way that a first magnet 1511*a* is accommodated inside a first magnet case 1511*b*. Since the first sensing module 161 detects whether there is a magnetic force generated by the first magnet 1511*a* or not, the first magnet 1511*a* may be disposed regardless of the polarity of the first magnet 1511*a*. Accordingly, the first magnetic object 1511 may be coupled to the first nozzle 151 at a time of manufacturing of the first nozzle 151, regardless of the polarity of the first magnet 1511*a*, ensuring efficiency in the manufacturing process.

The first magnet case 1511*b* may have a shape corresponding to the shape of the first magnet 1511*a*. For example, in the case where the first magnet 1511*a* has a bar shape, the first magnet case 1511*b* may have a rectangular cuboid shape to accommodate a bar magnet.

Referring back to FIG. 5, the first weight 1512 has weight corresponding to the weight of the first magnetic object 1511. The first weight 1512, as described above, is disposed in the end portion of the first nozzle 151, which is opposite to the end portion of the first nozzle 151 where the first magnetic object 1511 is disposed, to enable the center of gravity of the first nozzle 151 to move to the center of the first nozzle 151. Since the first weight 1512 is disposed as describe above, the shake of the first nozzle 151 at a time of rotation of the first nozzle 151 may be prevented, which is caused by a misalignment of the center of gravity of the first nozzle 151 with the center of the first nozzle 151 due to the first magnetic object 1511 disposed at one end of the first nozzle 151.

Figure 7:
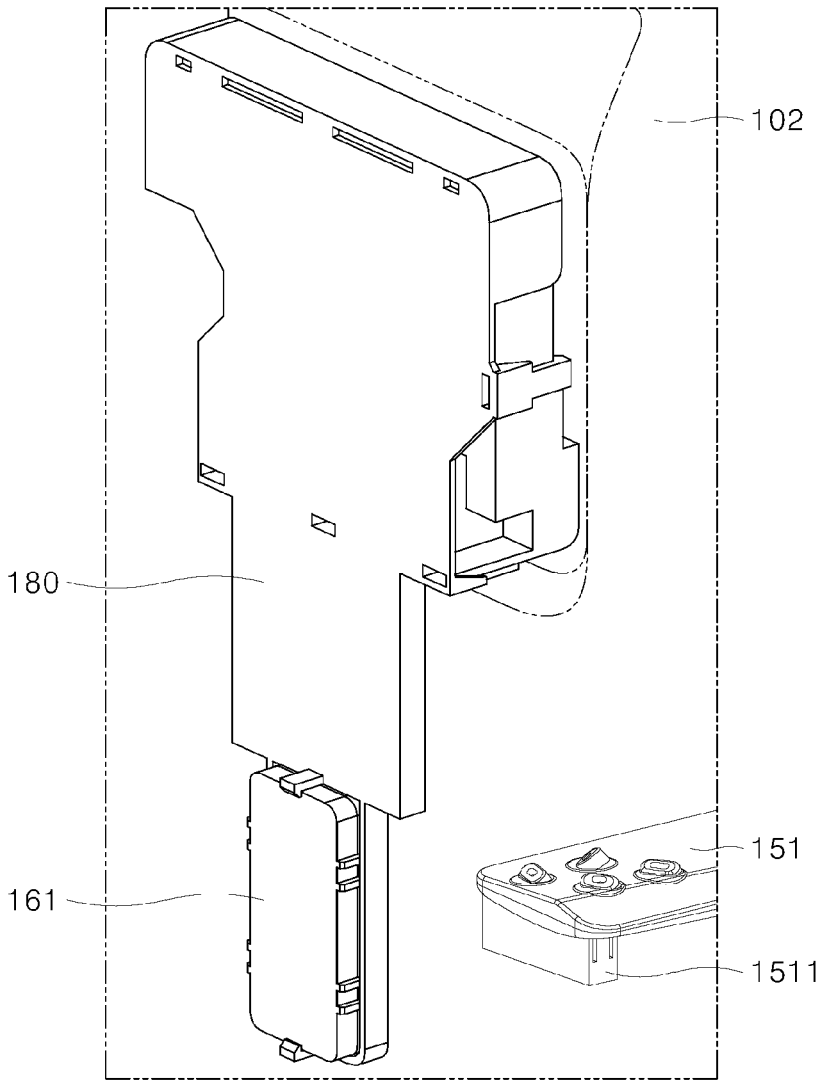
FIG. 7 is a view showing a structure in which a first sensing module is coupled to a dispenser through a fixation bracket, in the dishwasher of one embodiment.

FIG. 7 is a view showing a structure in which a first sensing module is coupled to a dispenser through a fixation bracket, in the dishwasher of one embodiment.

Referring to FIG. 7, the first sensing module 161 is coupled to the lower end of the dispenser 170 through the fixation bracket 180.

The dispenser 170 is disposed in one area of the door 102. At this time, the dispenser 170 may be disposed at the center of the upper end of the inner surface of the door 102, to allow the user to insert detergents readily. The dispenser 170 may supply detergents to the wash space 111 when the dishwasher 100 performs a process in which detergents are required.

The fixation bracket 180 is coupled to the dispenser 170. One end of the fixation bracket 180 is coupled to the dispenser 170 disposed at the door 102, and the first sensing module 161 is coupled to the other end of the fixation bracket 180. Since the first sensing module 161 is coupled to the dispenser 170 through the fixation bracket 180 as described above, the first magnetic object 1511 coupled to the first nozzle 151 may approach to the first sensing module 161, as illustrated in FIG. 7. Accordingly, the first sensing module 161 may sense a magnetic force generated by the first magnetic object 1511.

The first sensing module 161 comprises N−1 number of Hall sensors that are disposed in positions corresponding to N number of positions. A detailed structure of the first sensing module 161 is described with reference to FIG. 8.

Figure 8:
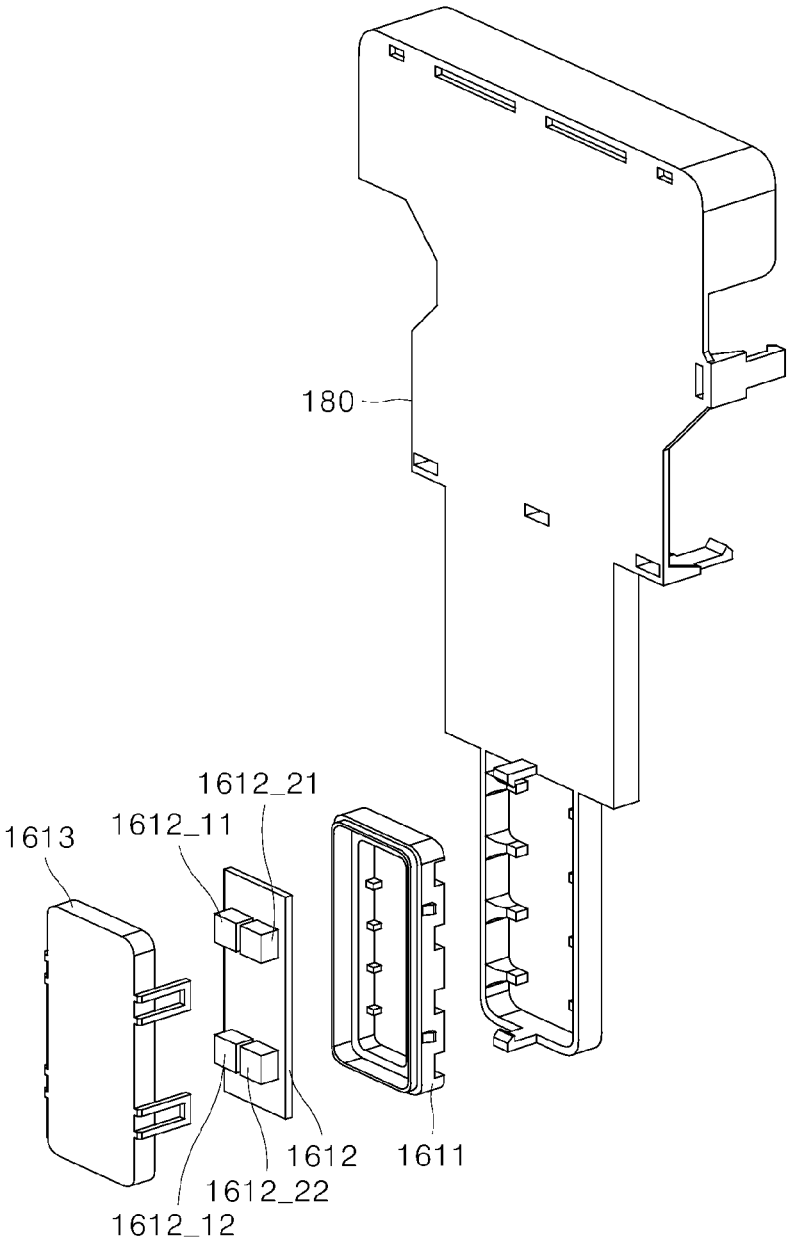
FIG. 8 is a view separately showing the first sensing module and the fixation bracket, in the dishwasher of one embodiment.

FIG. 8 is a view separately showing the first sensing module and the fixation bracket, in the dishwasher of one embodiment.

Referring to FIG. 8, the first sensing module 161 is disassembled and illustrated in a perspective view. The first sensing module 161 may comprise a first sensing module case 1611, a first sensing module substrate 1612, and a first sensing module cover 1613.

The first sensing module case 1611 is formed in a way that the first sensing module case 1611 is directly coupled to the fixation bracket 180, and accommodates the first sensing module substrate 1612.

The first sensing module cover 1613 covers the first sensing module substrate 1612 accommodated in the first sensing module case 1611, to prevent the first sensing module substrate 1612 from being exposed to the outside.

The first sensing module substrate 1612 is a substrate on which a plurality of Hall sensors is mounted. The plurality of Hall sensors is mounted on the first sensing module substrate 1612 at predetermined intervals, such that the plurality of Hall sensors senses a current position and a direction of rotation of the first nozzle 151. The plurality of Hall sensors may comprise a first Hall sensor part comprising N−1 number of Hall sensors that are disposed in positions corresponding to N number of positions, and a second Hall sensor part comprising N−1 number of Hall sensors that are disposed at one side of the first Hall sensor part and disposed in positions corresponding to N number of positions.

In the case where the first rack 141 and the first nozzle 151 move up and down to three positions, the Hall sensors on the first sensing module substrate 1612 is arranged as follows.

In the case where the first rack 141 and the first nozzle 151 move up and down to a first position, a second position and a third position, the Hall sensors on the first sensing module substrate 1612 may be mounted in a position corresponding to the intermediate position between the first position and the second position, and in a position corresponding to the intermediate position between the second position and the third position.

Additionally, for the first sensing module 161 to sense a direction of rotation of the first nozzle 151, two Hall sensors may be disposed left and right respectively in the position corresponding to the intermediate position between the first position and the second position and in the position corresponding to the meddle between the second position and the third position.

That is, as illustrated in FIG. 8, on the first sensing module substrate 1612, a first Hall sensor 1612_11 and a second Hall sensor 1612_21 may be mounted in an area of the position corresponding to the intermediate position between the first position and the second position, and a third Hall sensor 1612_12 and a fourth Hall sensor 1612_22 may be mounted in an area of the position corresponding to the intermediate position between the second position and the third position.

At this time, the first Hall sensor 1612_11 and the third Hall sensor 1612_12 that are disposed at a different height may be included in the first Hall sensor part. The second Hall sensor 1612_21 and the fourth Hall sensor 1612_22 that are disposed at a different height and disposed at one side of the first Hall sensor 1612_11 and the third Hall sensor 1612_12 may be include in the second Hall sensor part.

A relationship between the position of the first nozzle 151 and the position of the plurality of Hall sensors mounted on the first sensing module substrate 1612 can be described in detail with reference to FIGS. 9 and 10.

Figure 9:
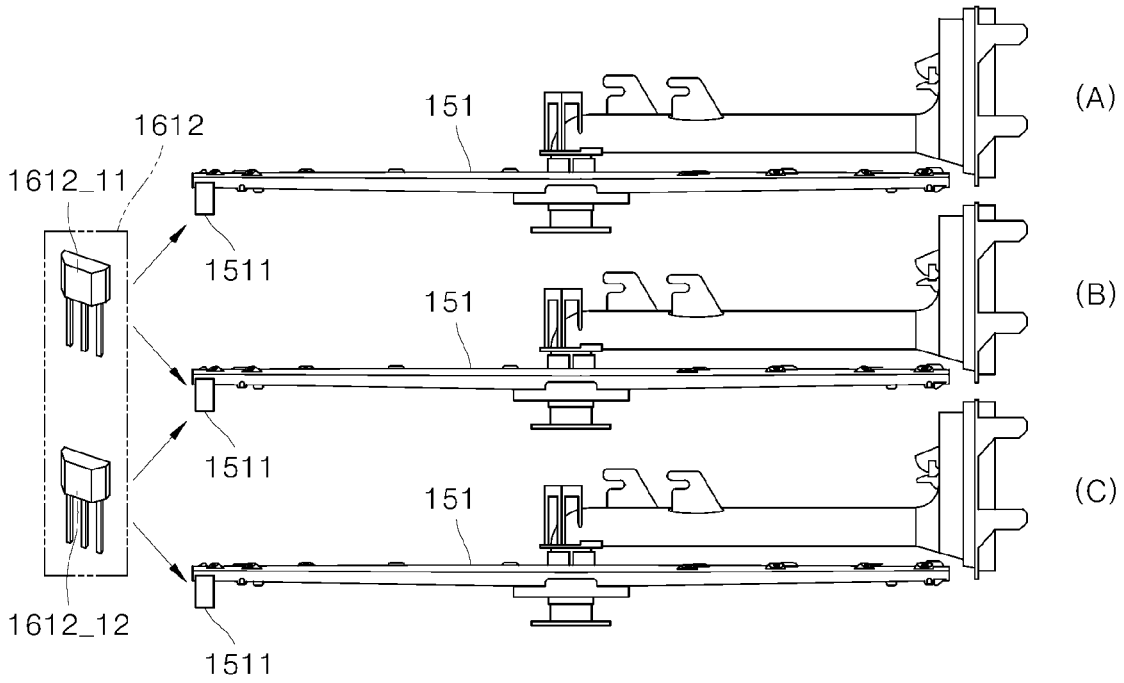
FIG. 9 is a view for describing a relationship between the position of the first nozzle and the position of a plurality of Hall sensors included in the first sensing module, in the dishwasher of one embodiment.

FIG. 9 is a view for describing a relationship between the position of the first nozzle and the position of a plurality of Hall sensors included in the first sensing module, in the dishwasher of one embodiment.

Referring to FIG. 9, the first sensing module substrate 1612 of the first sensing module 161 and the first nozzle 151 are viewed laterally.

At this time, the first nozzle 151 may move to the first position A that is an upper end, the second position B that is a middle end, and the third position C that is a lower end.

As the first sensing module 161 is coupled to the dispenser 170 through the fixation bracket 180, the first Hall sensor 1612_11 mounted on the first sensing module substrate 1612 of the first sensing module 161 may move to the position corresponding to the intermediate position between the first position A and the second position B, and the third Hall sensor 1612_12 mounted on the first sensing module substrate 1612 of the first sensing module 161 may move to the position corresponding to the intermediate position between of the first position A and the second position B.

Since the first Hall sensor 1612_11 and the third Hall sensor 1612_12 are disposed as described above, the first Hall sensor 1612_11 may sense a magnetic force generated by the first magnetic object 1511, in the case where the first nozzle 151 is disposed in the first position A or the second position B, and the third Hall sensor 1612_12 may sense a magnetic force generated by the first magnetic object 1511, in the case where the first nozzle 151 is disposed in the second position B or the third position C. Though not illustrated in the drawing, the second Hall sensor 1612_21 may be disposed at the same height as the first Hall sensor 1612_11, and the fourth Hall sensor 1612_22 may be disposed at the same height as the third Hall sensor 1612_12.

Accordingly, even when the position of the first nozzle 151 moves up and down, the controller may sense a magnetic force generated by the first magnetic object 1511. Further, the controller may determine the position of the first nozzle 151, based on a Hall sensor that senses a magnetic force generated by the first magnetic object 1511. That is, the controller may determine the positions of the first rack 141 and the first nozzle 151, based on a Hall sensor that senses a magnetic force generated by the first magnetic object 1511, among N−1 number of Hall sensors.

Figure 10:
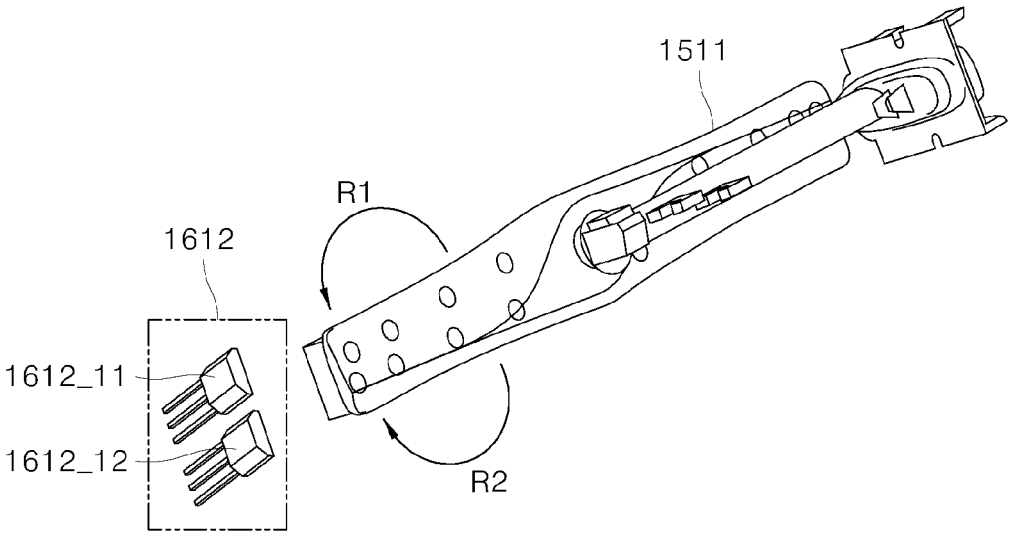
FIG. 10 is another view for describing a relationship between the position of the first nozzle and the position of the plurality of Hall sensors included in the first sensing module, in the dishwasher of one embodiment.

FIG. 10 is another view for describing a relationship between the position of the first nozzle and the position of the plurality of Hall sensors included in the first sensing module, in the dishwasher of one embodiment.

Referring to FIG. 10, the first sensing module substrate 1612 of the first sensing module 161 and the first nozzle 151 are viewed from above.

The first Hall sensor 1612_11 and the second Hall sensor 1612_21 on the first sensing module substrate 1612 may be disposed at the same height.

The first nozzle 151 may rotate counterclockwise R1 or clockwise R2.

As the first nozzle 151 rotates counterclockwise R1, a magnetic force generated by the first magnetic object 1511 is sensed by the first Hall sensor 1612_11 and then sensed by the second Hall sensor 1612_21. As the first nozzle 151 rotates clockwise R2, a magnetic force generated by the first magnetic object 1511 is sensed by the second Hall sensor 1612_21 and then sensed by the first Hall sensor 1612_11.

Accordingly, the controller may determine the position of the first nozzle 151, based on which Hall sensor senses the magnetic force of generated by the first magnetic object 1511, out of the Hall sensor included in the first Hall sensor part and the Hall sensor included in the second Hall sensor part.

Figure 11:
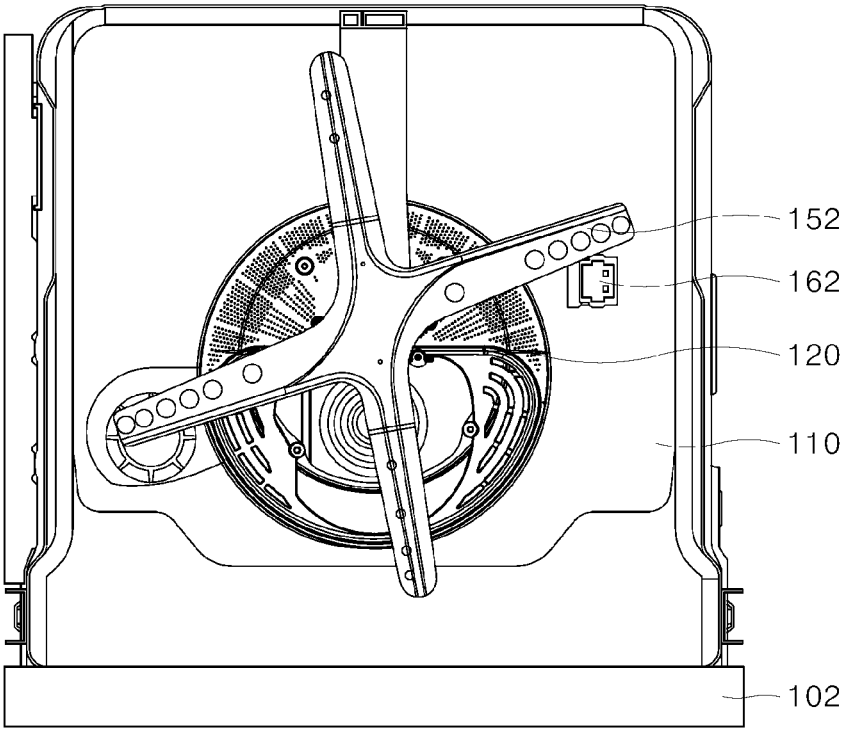
FIG. 11 is a view showing a configuration of a second nozzle disposed at the lower side of the dishwasher of one embodiment.

FIG. 11 is a view showing a configuration of a second nozzle disposed at the lower side of the dishwasher of one embodiment.

Referring to FIG. 11, the second nozzle 152 may be disposed near the lower surface of the tub 110 at the lower end of the wash space 111. The sump 120 is disposed in the lower portion of the tub 110. At this time, the second sensing module 162 is coupled to one side of the sump 120.

The second nozzle 152, as illustrated in FIG. 3, is disposed at the lower end of the second rack 142. A second magnetic object 1521 may be coupled to one end of the second nozzle 152, and have a second weight 1522 at the other end thereof. A detailed structure of the second nozzle 152 is described with reference to FIG. 12.

Figure 12:
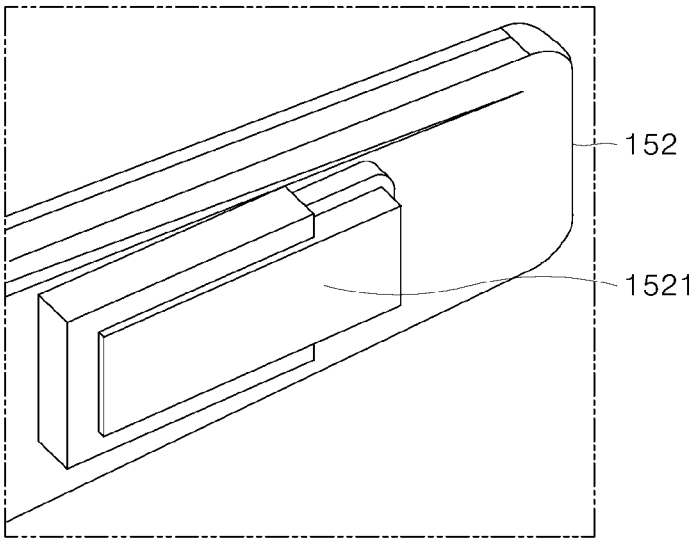
FIG. 12 is a view showing a structure in which a second magnetic object is coupled to the second nozzle, in the dishwasher of one embodiment.

FIG. 12 is a view showing a structure in which a magnetic object is coupled to the second nozzle, in the dishwasher of one embodiment.

Referring to FIG. 12, the second magnetic object 1521 is coupled to one end of the second nozzle 152. Though not illustrated in FIG. 12, the second weight 1522 is accommodated at the other end of the second nozzle 152, as illustrated in FIG. 3. The second magnetic object 1521 rotates together with the second nozzle 152 as the second nozzle 152 rotates, causing a change in a magnetic field, to enable the second sensing module 162 to sense a magnetic force generated by the second magnetic object 1521. In one embodiment, the second magnetic object 1521 may be a magnet.

Figure 13:
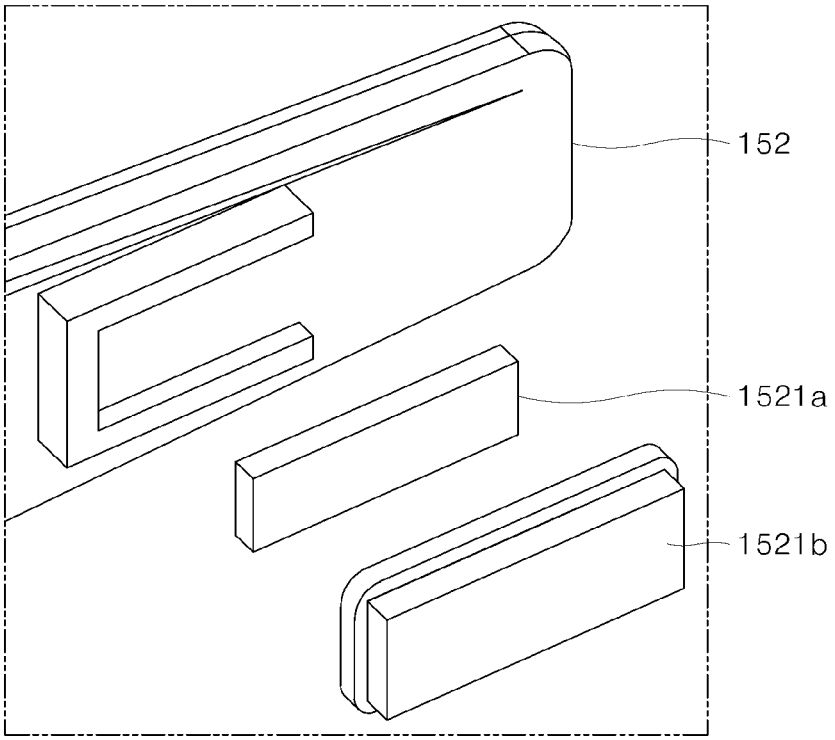
FIG. 13 is a view separately showing the structure in which the second magnetic object is coupled to the second nozzle, in the dishwasher of one embodiment.

A structure in which the second magnetic object 1521 is coupled to the second nozzle 152 is illustrated in FIG. 13.

FIG. 13 is a view separately showing the structure in which a magnetic object is coupled to the second nozzle, in the dishwasher of one embodiment.

Referring to FIG. 13, the second magnetic object 1521 may be coupled to the lower side of one end of the second nozzle 152.

The second magnetic object 1521 may be coupled to the lower side of one end of the second nozzle 152 in a way that a second magnet 1521*a* is accommodated inside a second magnet case 1521*b*. Since the second sensing module 162 senses whether there is a magnetic force generated by the second magnet 1521*a*, the second magnet 1521*a* may be disposed regardless of the polarity. Thus, at a time of manufacturing the second nozzle 152, the second magnet 1521*a* may be coupled to the second nozzle 152 regardless of the polarity, ensuring efficiency in the manufacturing process.

The second magnet case 1521*b* may have a shape corresponding to the shape of the second magnet 1521*a*. For example, in the case where the second magnet 1521*a* is shaped into a bar magnet, the second magnet case 1521*b* may be formed in a way that a bar magnet is accommodated.

Referring back to FIG. 12, the second weight 1522 has weight corresponding to the weight of the second magnetic object 1521. The second weight 1522, as described above, is disposed in an end portion of the second nozzle 152, which is opposite to the end portion of the second nozzle 152 where the second magnetic object 1521 is disposed, to enable the center of gravity of the second nozzle 152 to move to the center of the second nozzle 152. Since the second weight 1522 is disposed as describe above, the shake the second nozzle 152 at a time of rotation of the second nozzle 152 may be prevented, which is caused by a misalignment of the center of gravity of the second nozzle 152 with the center of the second nozzle 152 due to the second magnetic object 1521 disposed at one end of the second nozzle 152.

Figure 14:
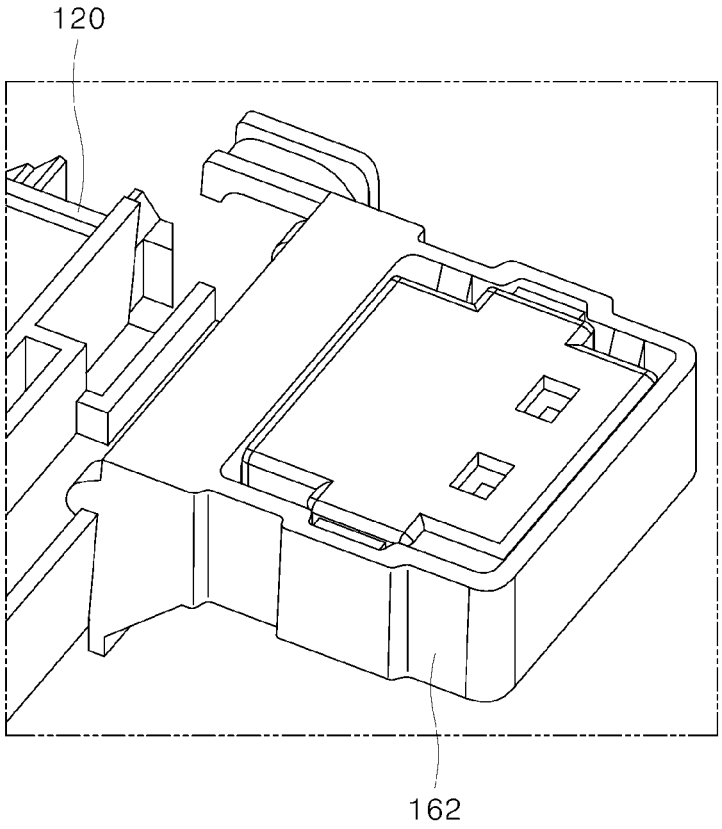
FIG. 14 is a view showing a structure in which the second sensing module is coupled to a sump, in the dishwasher of one embodiment.

FIG. 14 is a view showing a structure in which the second sensing module is coupled to a sump, in the dishwasher of one embodiment.

Referring to FIG. 14, the second sensing module 162 is coupled to one side of the sump 120. A detailed structure of the second sensing module is described with reference to FIG. 15.

Figure 15:
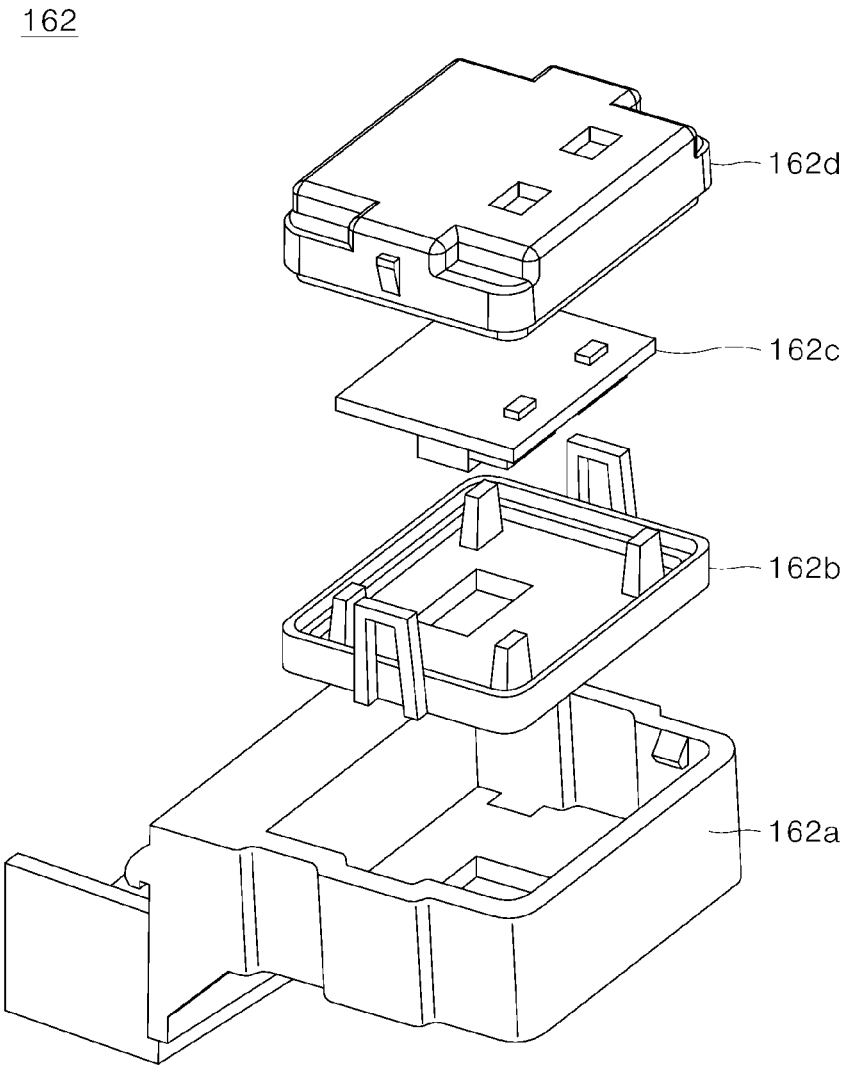
FIG. 15 is a view separately showing the second sensing module of the dishwasher of one embodiment.

FIG. 15 is a view separately showing the second sensing module of the dishwasher of one embodiment.

Referring to FIG. 15, the second sensing module 162 comprises a second sensing module bracket 162*a*, a second sensing module case 162*b*, a second sensing module substrate 162*c* and a second sensing module cover 162*d*.

The second sensing module bracket 162*a* couples the second sensing module 162 to one side of the sump 120. To this end, the second sensing module bracket 162*a* may have a structure corresponding to the structure of the sump 120, to be coupled to the sump 120.

The second sensing module case 162*b* is accommodated in the second sensing module bracket 162*a*. The second sensing module case 162*b* accommodates the second sensing module substrate 162*c*.

The second sensing module cover 162*d* covers the second sensing module substrate 162*c* such that the second sensing module substrate 162*c* accommodated in the second sensing module case 162*b* is not exposed to the outside.

A plurality of Hall sensors is mounted on the second sensing module substrate 162*c*. The plurality of Hall sensors is mounted on the second sensing module substrate 162*c* at predetermined intervals, to sense a direction of rotation of the second nozzle 152.

Two Hall sensors may be disposed on the second sensing module substrate 162*c* along a direction of rotation of the second nozzle 152. Accordingly, the second sensing module substrate 162*c* may determine a direction of rotation of 152, based on which Hall sensor senses a magnetic force generated by the second magnetic object 1521.

Referring back to FIG. 3, results of the sensing of the above-described first sensing module 161 and second sensing module 162 may be output to the controller.

The controller controls the entire operations of the dishwasher. The controller may be embodied in a way that the controller comprises a physical element comprising at least one of application specific integrated circuits (ASICs), digital signal processors (DSPs), digital signal processing devices (DSPDs), programmable logic devices (PLDs), field programmable gate arrays (FPGAs), controllers, micro-controllers and microprocessors.

The controller receives sensing results from the first sensing module 161 and the second sensing module 162, and based on the sensing results, determines one or more of whether the nozzles 151, 152 rotate, a speed of rotation of the nozzles 151, 152 and a direction of rotation of the nozzles 151, 152, to output an abnormality notification to the user or control wash water that is supplied to the nozzles 151, 152 through the wash pump 130.

Detailed operations of the controller are described with reference to FIGS. 16 to 18.

Figure 16:
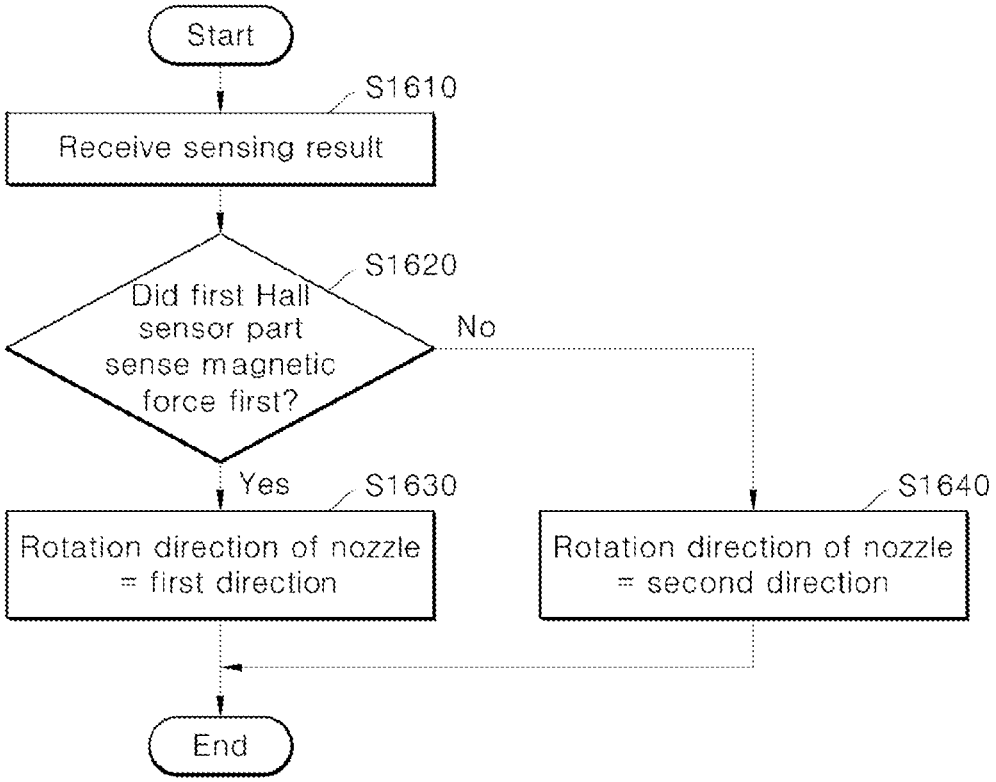
FIG. 16 is a flowchart for describing a process in which the dishwasher of one embodiment determines a rotation direction of a nozzle.

FIG. 16 is a flowchart for describing a process in which the dishwasher of one embodiment determines a rotation direction of a nozzle.

Referring to FIG. 16, the controller receives sensing results from the first sensing module 161 and the second sensing module 162 (S1610).

Hereafter, the controller that receives sensing results from the first sensing module 161 and determines a direction of rotation of the first nozzle 151 is described, but not limited. That is, in the same way, the controller may receive sensing results from the second sensing module 162 and determine a direction of rotation of the second nozzle 152.

Then the controller determines whether the first Hall sensor parts 1612_11, 1612_12 first sense a magnetic force, based on the sensing results (S1620).

Having determined that the first Hall sensor parts 1612_11, 1612_12 first sensed a magnetic force, the controller determines that a direction of rotation of the first nozzle 151 is a first direction (S1630). Having determined that the second Hall sensor parts 1612_21, 1612_22 first sensed a magnetic force, instead of the first Hall sensor parts 1612_11, 1612_12, the controller determines that a direction of rotation of the first nozzle 151 is a second direction (S1640).

At this time, the first direction and the second direction are opposite to each other. For example, the first direction may be a counterclockwise direction, and the second direction may be a clockwise direction.

Figure 17:
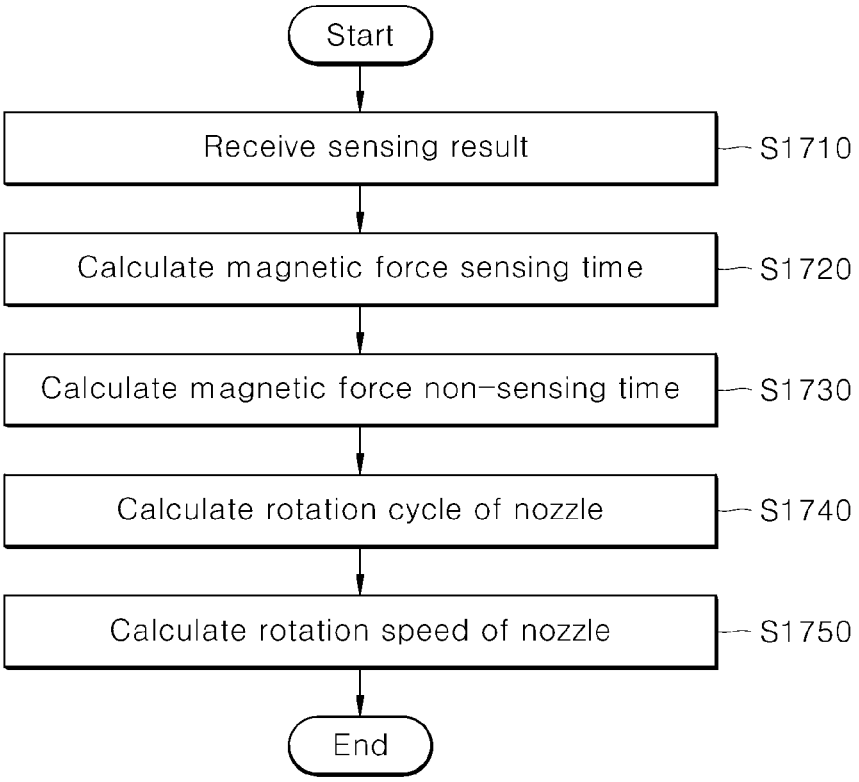
FIG. 17 is a flowchart for describing a process in which the dishwasher of one embodiment determines a rotation speed of a nozzle.

FIG. 17 is a flowchart for describing a process in which the dishwasher of one embodiment determines a rotation speed of a nozzle.

Referring to FIG. 17, the controller receives sensing results from the sensing modules 161, 162 (S1710).

Then the controller calculates magnetic force sensing time for which the sensing modules 161, 162 sense a magnetic force (S1720). Additionally, the controller calculates magnetic force non-sensing time for which the sensing modules 161, 162 cannot sense a magnetic force (S1730). At the time, step 1720 and step 1730 may be performed in reverse order.

Then the controller calculates rotation cycles of the nozzles 151, 152 (S1740). The rotation cycles of the nozzles 151, 152 may be calculated by adding the magnetic force sensing time and the magnetic force non-sensing time. For example, in the case where the magnetic force sensing time is 0.5 s and the magnetic force non-sensing time is 4.5 s, the rotation cycles of the nozzles 151, 152 may be calculated as 5 s.

Then the controller calculates rotation speeds of the nozzles 151, 152 (S1750). The rotation speeds of the nozzles 151, 152 may be calculated based on the rotation cycles of the nozzles 151, 152. For example, when the rotation cycles of the nozzles 151, 152 are 5 s, it means that the nozzles 151, 152 rotate 12 times for one minute. Thus, the rotation speeds of the nozzles 151, 152 may be calculated as 12 RPM.

The controller, as described above, may calculate the rotation speeds of the nozzles 151, 152, based on the magnetic force sensing time and the magnetic force non-sensing time through the sensing modules 161, 162.

Figure 18:
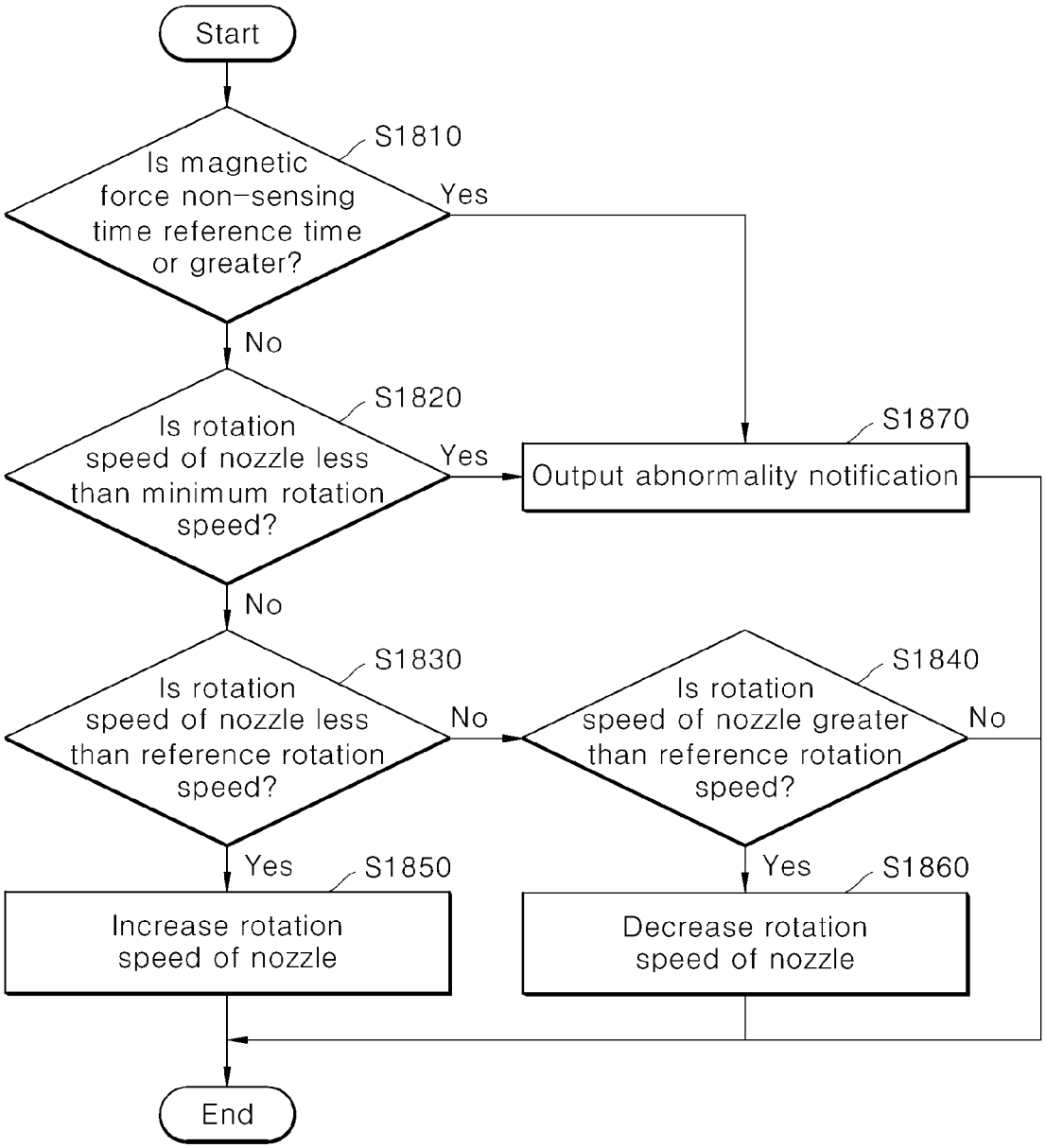
FIG. 18 is a flowchart for describing a method in which the dishwasher of one embodiment controls the rotation of a nozzle or outputs an abnormality notification to the user, based on whether a nozzle rotates, a rotation speed of the nozzle, and a rotation direction of the nozzle.

FIG. 18 is a flowchart for describing a method in which the dishwasher of one embodiment controls the rotation of a nozzle or outputs an abnormality notification to the user, based on whether a nozzle rotates, a rotation speed of the nozzle, and a rotation direction of the nozzle.

Referring to FIG. 18, the controller determines whether the magnetic force non-sensing time is predetermined reference time or greater (S1810).

The reference time denotes a time criterion for determining that the nozzles 151, 152 do not rotate smoothly. For example, the reference time may be set to 10 s. That is, in the case where a magnetic force is not sensed through the sensing modules 161, 162 for the reference time or greater, the controller may determine that the nozzles 151, 152 do not rotate smoothly.

Accordingly, in the case where the magnetic force non-sensing time is the predetermined reference time or greater, the controller outputs an abnormality notification to the user (S1870). The controller may output an abnormality notification by transmitting a notification message to a user terminal linked with the dishwasher 100, or outputting a notification through an interface (not illustrated), a speaker (not illustrated) or an LED (not illustrated) included in the dishwasher 100.

Determining that the magnetic force non-sensing time is less than the predetermined reference time, the controller determines whether the rotation speed of the nozzle is less than a predetermined minimum rotation speed (S1820).

The minimum rotation speed is a speed criterion for determining that the nozzles 151, 152 do not rotate smoothly. For example, the minimum rotation speed may be set to 6 RPM. That is, in the case where the rotation speeds of the nozzles 151, 152 are less than the minimum rotation speed, the controller may determine that the nozzles 151, 152 do not rotate smoothly.

Accordingly, in the case where the rotation speeds of the nozzles 151, 152 are less than the minimum rotation speed, the controller outputs an abnormality notification to the user (S1870).

Determining that the rotations speeds of the nozzles 151, 152 are the minimum rotation speed or greater, the controller determines whether the rotation speeds of the nozzles 151, 152 are less than a predetermined reference rotation speed (S1830).

The reference rotation speed is a speed at which the controller controls the nozzles 151, 152 to enable the nozzles 151, 152 to rotate. The reference rotation speed may have a different value from the value of the rotation speed of the nozzle 151, 152, for the reason that contaminants are excessively stacked in the filter 123 or a wash target is disposed in an area of rotation of the nozzle 151, 152, and the like.

At this time, the reference rotation speed may be set differently, depending on the rotation directions of the nozzles 151, 152.

In the case where the rotation speeds of the nozzle 151, 152 are less than the reference rotation speed, the controller controls wash water that is supplied to the nozzles 151, 152 through the wash pump 130, to increase the rotation speeds of the nozzles 151, 152 (S1850).

Unless the rotation speeds of the nozzles 151, 152 are less than the reference rotation speed, the controller determines whether the rotation speeds of the nozzles 151, 152 are greater than the reference rotation speed (S1840).

In the case where the rotation speeds of the nozzles 151, 152 are greater than the reference rotation speed, the controller controls wash water that is supplied to the nozzles 151, 152 through the wash pump 130, to decrease the rotation speeds of the nozzles 151, 152 (S1860).

Unless the rotation speeds of the nozzles 151, 152 are greater than the reference rotation speed, the rotation speeds of the nozzles 151, 152 are the same as the reference rotation speed. Accordingly, the controller exerts no control.

The controller, as described above, may output an abnormality notification to the user, based on whether the nozzle 151, 152 rotates, or control the rotation of the nozzle 151, 152, based on the rotation speed and rotation direction of the nozzle 151, 152.

As described above, the dishwasher 100 of one embodiment can sense whether the nozzle 151 rotates by using (N−1) Hall sensors that are disposed in positions corresponding to N positions to which the nozzle 151 moves, even if the position of the nozzle 151 changes. (N is a positive integer)

Additionally, the magnetic object 1511, 1521 is disposed at one end of the nozzle 151, 152, and the weight 1512, 1522 is disposed at the other end of the nozzle 151, 152, such that the nozzle 151, 152 can rotate smoothly.

Further, the first Hall sensor part and the second Hall sensor part disposed at one side of the first Hall sensor part sense the rotation direction and the rotation speed of the nozzle 151, 152, ensuring precise control of the rotation of the nozzle 151, 152 and improvement in the performance of the dishwasher 100.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the range of the disclosure though not explicitly described in the description of the embodiments.

The invention claimed is:

1. A dishwasher comprising:

a tub defining a wash space configured to accommodate a wash object;

a sump disposed at a lower end of the tub and configured to receive wash water;

a wash pump configured to pass the wash water from the sump;

a rack disposed in the wash space and configured to accommodate the wash object;

a nozzle disposed at a lower end of the rack and having one end coupled to a magnetic object, wherein the nozzle is configured to (i) rotate, based on the wash water being supplied from the wash pump into the nozzle, and (ii) spray the wash water towards the wash object;

a sensing module disposed at an area that corresponds to a range in which the nozzle is configured to operate, and comprising at least one Hall sensor part configured to sense a magnetic force generated by the magnetic object; and a controller configured to:

receive sensing results from the sensing module, determine one or more of (i) whether the nozzle rotates, (ii) a rotation speed of the nozzle, and (iii) a rotation direction of the nozzle, and based on the sensing results, output an abnormality notification to a user or control the wash water that is supplied to the nozzle through the wash pump, wherein the sensing module includes a first Hall sensor part and a second Hall sensor part that is disposed at one side of the first Hall sensor part.

2. The dishwasher of claim 1, wherein the rack comprises a first rack disposed at an upper portion of the wash space and configured to move up and down to N number of positions, wherein Nis a natural number of 2 or more, wherein the nozzle comprises a first nozzle disposed at a lower end of the first rack and configured to move up and down to the N number of positions with the first rack, and wherein the sensing module comprises a first sensing module comprising N−1 number of Hall sensors that are disposed at positions corresponding to the N number of positions.

3. The dishwasher of claim 2, wherein a first magnetic object is coupled to a first end of the first nozzle, and wherein a first weight having a same weight as a weight of the first magnetic object is disposed at a second end of the first nozzle.

4. The dishwasher of claim 2, further comprising:

a door disposed at one surface of the tub and configured to open and close the wash space;

a dispenser disposed at one area of the door and configured to supply detergents to the wash space; and a fixation bracket coupled to the dispenser and accommodating the first sensing module.

5. The dishwasher of claim 2, wherein the controller is configured to, based on the at least one Hall sensor part sensing a magnetic force generated by the magnetic object, determine a position of the first rack and the first nozzle, among the N number of positions.

6. The dishwasher of claim 2, wherein the first sensing module comprises:

the first Hall sensor part comprising N−1 number of Hall sensors disposed at positions corresponding to the N number of positions, and the second Hall sensor part disposed at one side of the first Hall sensor part and comprising N−1 number of Hall sensors disposed at positions corresponding to the N number of positions.

7. The dishwasher of claim 6, wherein the controller is configured to, based on an order in which the first Hall sensor part and the second Hall sensor part sense a magnetic force generated by the magnetic object, determine a rotation direction of the first nozzle.

8. The dishwasher of claim 1, wherein the rack comprises a second rack disposed at a lower portion of the wash space, wherein the nozzle comprises a second nozzle disposed at a lower end of the second rack, and wherein the sensing module comprises a second sensing module coupled to one side of the sump.

9. The dishwasher of claim 8, wherein a second magnetic object is coupled to a first end of the second nozzle, and wherein a second weight having a same weight as a weight of the second magnetic object is disposed at a second end of the second nozzle.

10. The dishwasher of claim 1, wherein the controller is configured to, based on the sensing results from the sensing module, calculate the rotation speed of the nozzle, wherein the sensing results include magnetic force sensing time and magnetic force non-sensing time.

11. The dishwasher of claim 10, wherein the controller is configured to, based on the magnetic force non-sensing time being greater than a predetermined reference time, output the abnormality notification to the user.

12. The dishwasher of claim 1, wherein the controller is configured to, based on the rotation speed of the nozzle being less than a predetermined minimum rotation speed, output the abnormality notification to the user.

13. The dishwasher of claim 1, wherein the controller is configured to, based on comparing the rotation speed of the nozzle and a predetermined reference rotation speed, control the wash water that is supplied to the nozzle through the wash pump.

14. The dishwasher of claim 13, wherein the predetermined reference rotation speed is set depending on the rotation direction of the nozzle.

15. The dishwasher of claim 13, wherein the controller is configured to, (i) based on the rotation speed of the nozzle being less than the predetermined reference rotation speed, control wash water that is supplied to the nozzle through the wash pump to increase the rotation speed of the nozzle, and (ii) based on the rotation speed of the nozzle being greater than the predetermined reference rotation speed, control wash water that is supplied to the nozzle through the wash pump to decrease the rotation speed of the nozzle.

16. The dishwasher of claim 4, wherein the first sensing module comprises:

a first sensing module case coupled to the fixation bracket;

a first sensing module substrate disposed at the first sensing module case; and a first sensing module cover that covers the first sensing module substrate.

17. The dishwasher of claim 8, wherein the second sensing module comprises:

a second sensing module bracket that couples the second sensing module to the one side of the sump;

a second sensing module case disposed at the second sensing module bracket;

a second sensing module substrate disposed at the second sensing module case; and a second sensing module cover that covers the second sensing module substrate.

* * * * *